US005219419A

United States Patent [19]

Prothe

[11] Patent Number: 5,219,419

[45] Date of Patent: Jun. 15, 1993

[54] STACKABLE MUG

[75] Inventor: Kevin R. Prothe, Osawatomie, Kans.

[73] Assignee: Packer Plastics, Incorporated, Lawrence, Kans.

[21] Appl. No.: 970,043

[22] Filed: Nov. 2, 1992

[51] Int. Cl.[5] ..... B65D 25/28

[52] U.S. Cl. ..... 206/515; 206/519; 220/769; 220/771

[58] Field of Search ..... 206/519, 515; 220/756, 220/768, 769, 771

[56] References Cited

U.S. PATENT DOCUMENTS

| | | | |
|---|---|---|---|
| 2,803,375 | 8/1957 | Meshberg | 206/515 |
| 2,885,134 | 5/1959 | Cohen . | |
| 2,932,437 | 4/1960 | Wilcox | 206/515 |
| 3,596,795 | 8/1971 | D'Ercoll . | |
| 3,810,470 | 5/1974 | Von Gunten . | |
| 3,841,828 | 10/1974 | Eisenberg | 206/519 |
| 4,049,187 | 9/1977 | Horian | 206/519 |
| 4,136,022 | 1/1979 | Hutzler et al. . | |
| 4,136,072 | 1/1979 | Hutzler et al. | 206/515 |
| 4,467,934 | 8/1984 | Hummer | 206/515 |
| 5,111,954 | 5/1992 | Gaudreault | 206/519 |

FOREIGN PATENT DOCUMENTS

| | | | |
|---|---|---|---|
| 227083 | 7/1969 | Sweden | 206/519 |

*Primary Examiner*—Joseph Man-Fu Moy

*Attorney, Agent, or Firm*—Kokjer, Kircher, Bowman & Johnson

[57] ABSTRACT

A drinking mug constructed to nest when stacked with other mugs. A frusto-conical mug body is provided with a hollow handle which extends vertically and is spaced away from the mug body by an inverted channel beam having a web and two side flanges. When mugs are stacked, the mug bodies nest together and the handles nest together to minimize the height of the stack and thus provide a compact stack. Stacking lugs cooperate with lips on a handle connection beam to provide the stack with stability.

17 Claims, 1 Drawing Sheet

STACKABLE MUG

FIELD OF THE INVENTION

This invention relates in general to containers for beverages and more particularly to a drinking mug which is specially constructed to nest with other mugs in a compact stack.

BACKGROUND OF THE INVENTION

Drinking mugs have been provided in both insulated and non-insulated constructions for use with beverages of various types. Typically, the mug has a curved handle which attaches at both ends with the mug body. This type of handle does not always provide a comfortable grip and can place the fingers against the mug body where they can become burned if hot liquids are contained in the mug. Perhaps even more importantly, the presence of a conventional curved handle precludes nesting of the mugs one within the other. Consequently, the mugs cannot be stacked in a compact configuration and often cannot be stacked at all. Automatic dispensing of conventional mugs is usually precluded, as is the use of high speed printing equipment such as offset printers for decorating the mug.

SUMMARY OF THE INVENTION

The present invention is directed to drinking mug which is equipped with a special handle that allows mugs to nest within one another for compact stacking. The handle also provides a more comfortable and convenient hand grip than conventional curved handles, and its special construction provides enhanced rigidity and strength without requiring an undue wall thickness. The mug is well suited for automatic dispensing and for high speed printing processes.

In accordance with the invention, a mug has a downwardly tapered body that presents a fluted base section. A frusto-conical handle is connected with the mug body by a special connector construction that spaces the handle away from the mug body. The handle extends vertically and is open at the top. The lower end of the handle is free rather than being connected with the mug body. Consequently, the mugs can be stacked with the mug bodies and handles both nesting together in order to minimize the height of the stack and the space that it occupies. Stacking lugs on the inside of the base section of the mug provide the stack with stability where the mugs are nested together.

The construction of the handle and the manner of its connection with the mug body provide considerable strength and rigidity. The structure which connects the handle includes a flat web at the top and flanges at the sides to form what is essentially an inverted channel beam. This beam like arrangement exhibits considerable structural strength which is able to withstand normal stresses without the need for thick or unduly large connection elements. At the same time, the handle is generally cylindrical although slightly tapered from top to bottom. This configuration provides inherent strength and allows a thin wall handle construction which is well suited for conventional plastic molding techniques.

DESCRIPTION OF THE DRAWINGS

In the accompanying drawings which form a part of the specification and are to be read in conjunction therewith and in which like reference numerals ar used to indicate like parts in the various views.

DETAILED DESCRIPTION OF THE INVENTION

Figure 1:
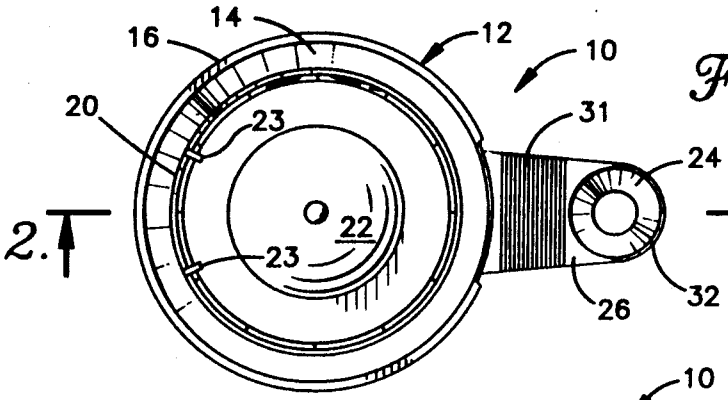
FIG. 1 is a top plan view of a drinking mug constructed according to a preferred embodiment of the present invention.

Referring now to the drawings in more detail, numeral 10 generally designates a mug for holding various types of beverages. The mug 10 is a non-insulated mug, but it should be understood that the mug construction of the present invention is equally well suited for mugs that are insulated.

The mug 10 has a mug body 12 which is formed by a frusto-conical wall 14 that tapers from top to bottom. The mug body 12 is open at the top, and a circular rim 16 extends around most of the top edge of the wall 14.

At the bottom portion of the mug body 12, a fluted base 18 is connected with the frusto-conical wall 14 by a shoulder 20. The shoulder 20 is annular and extends inwardly between the lower edge of the wall 14 and the upper edge of the base 18. The shoulder 20 faces upwardly within the open interior of the mug body 12. The mug body 12 has a bottom 22 Which is generally circular.

A pair of stacking lugs 23 are formed on the base 18 and project inwardly from the inside surface of the mug body. The lugs 23 are spaced apart by an arc of about 50° and are located about 25° from a position diametrically opposite a handle 24, as best shown in FIG. 1. The top edge of each lug projects inwardly from the shoulder 20 to provide a surface for receiving the bottom of an overlying mug, as will be explained more fully. Each lug 23 extends downwardly from the shoulder 20 to the bottom 22 along the all of the base 18.

Figure 2:
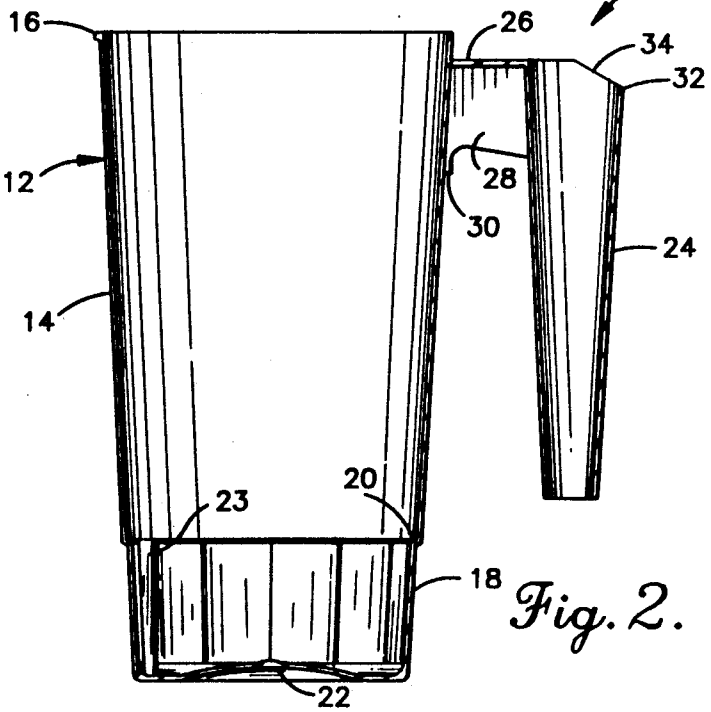
FIG. 2 is a sectional view taken generally along line 2—2 of FIG. 1 in the direction of the arrows.
Figure 3:
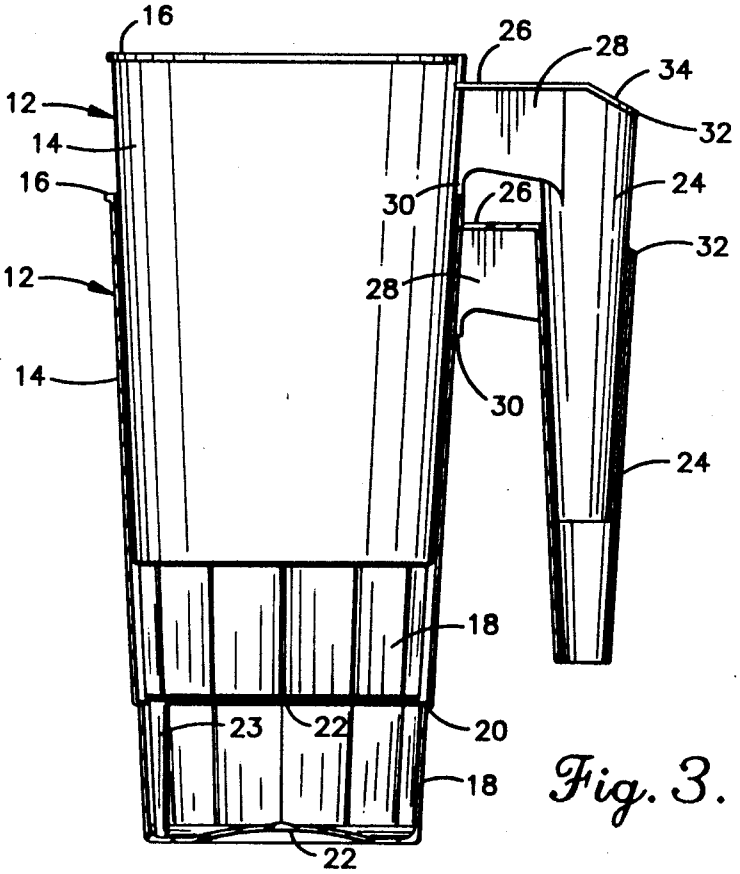
FIG. 3 is a side elevational view showing two of the mugs stacked together and nesting one within the other, with the lower of the two mugs shown in section.

In accordance with the present invention, the handle 24 is connected with the mug body 12 by a connection element 25 which takes the general form of a tapered channel member which is inverted. The connection element includes a flat web 26 which extends outwardly from the wall 14 a short distance below its top end. As best shown in FIG. 1, the web 26 has opposite side edges which diverge as they extend outwardly away from the mug body 12 toward the handle 24. Extending downwardly from the opposite side edges of the web 26 are a pair of flanges 28 (FIGS. 2 and 3). Each flange 28 is connected at its inner edge with the mug body 12 and at its outer edge with the handle 24. Each flange 28 has a downwardly projecting lip 30 located adjacent to the wall 14 of the mug body. The flat upper surface of the web 26 is ridged or roughened, as indicated at 31 in FIG. 1.

The handle 24 has a frusto-conical configuration and tapers from top to bottom. The longitudinal axes of the mug body 12 and handle 24 are vertical. The handle 24 is hollow and is open at both the top and bottom. The web 26 merges with the top end of the handle 24 and provides a lip 32 (see FIG. 1) that extends partially around the upper end of the handle. As best shown in FIG. 2, the top edge of the handle 24 is beveled at 34. The bevel 34 is formed on approximately the outer one-half of the top edge of the handle and preferably forms an angle of approximately 30° to horizontal.

The handle 24 is spaced well away from the mug body 12. The distance of the handle away from the mug body is determined by the length of the web 26 and flanges 28, and this distance can vary as desired. However, the web 26 and flanges 28 are preferably somewhat longer than the diameter of the fingers so that when the fingers are applied to the handle 24 they are spaced away from the mug body 12.

In use, the mug 10 may be filled with beverages or other liquids. The handle 24 provides a comfortable and convenient hand grip by which the mug can be used for drinking of the beverages. The round and slightly tapered configuration of the handle 24 fits in the hand more comfortably than handles that are shaped differently. As previously indicated, the fingers are maintained away from the mug body when they are applied to the handle. Consequently, if hot beverages are being handled by the mug, burning of the fingers is avoided.

The principal advantage of the configuration of the mug 10 is that it enables the mug to be nested within another mug when arranged in a stack of mugs. For example, FIG. 3 depicts two of the mugs stacked together in nesting relationship. It is noted that the mug bodies 12 fit closely within one another and that the handles 24 also nest within one another. In the stacked position, the bottom 22 of the top mug rests on top of the stacking lugs 23 of the bottom mug, and the majority of the handle 24 of the top mug fits within the handle of the lower mug. The bottom edges of the lips 30 fit against the top edge of the mug body 12. The contact between the mug bottom 22 and the lugs 23 and between the lips 30 and the top edge of the mug body limits the downward movement of the top mug within the lower mug. This prevents the mugs from becoming wedged tightly together and possibly being difficult to separate. In addition, the stacking lugs 23 and lips 30 provide stability in that the mugs are unable to pivot relative to one another due to the contact of the lugs and lips with the mugs. Consequently, a stack containing a large number of mugs is maintained in a straight condition and the mugs are not skewed relative to one another.

Because the mugs are able to nest together in this fashion when arranged in a stack, the mugs can be stored or packaged in a compact configuration. The height of the stack is minimized because the mug bodies and handles are nested one within the other in the stack. Accordingly, the space occupied by the mugs when stacked is minimized, and this is a distinct advantage in situations where a large number of mugs are involved.

The beam like structure which is formed by the web 26 and flanges 28 provides a strong and rigid connection means for the handle 24. In addition, the fact that the handle 24 is generally cylindrical although tapered somewhat from top to bottom provides an inherently strong and rigid structure which permits the handle to exhibit the necessary strength while having a thin wall construction. The taper of both the mug body 12 and handle 24 facilitates entry of the mug body and handle into an underlying mug body and handle when the mugs are to be arranged in a stack. The provision of the lip 32 and the bevel 34 enhances the strength and rigidity of the handle structure. In addition, the flat web 26 in cooperation with the bevel 34 provides a thumb rest on top of the handle, with the ridged surface 31 providing a high friction surface for the thumb. Because the lower end of the handle 24 is free and is spaced outwardly from the mug body 12, the handle provides a convenient hook by which the mug can be hung.

The configuration of the mug lends itself well to commonly used plastic molding techniques. Preferably, the mug 10 is molded in a single integral piece. The mug configuration also lends itself to automatic dispensing techniques which provide a significant advantage in mass production operations. Furthermore, the outside surface of the mug body 12 can be provided with printed matter used for decorative purposes through the use of offset printers and other high speed, automatic printing equipment.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A mug constructed to nest when stacked on another mug, comprising:

a mug body having a wall and a bottom, said mug body being open at a top thereof and defining a container for receiving and holding liquid in the mug body;

a handle connection element extending outwardly from said wall of the mug body in proximity to the top thereof; and a handle connected with said connection element and extending downwardly therefrom at a location spaced away from the mug body, said handle presenting a hollow interior open at the top and terminating in a free lower end spaced away from said wall of the mug body, whereby said mug body can be fitted inside of an underlying second mug with said handle fitting in the interior of the handle of the underlying second mug to accommodate nesting of the mug bodies and handles when the mugs are stacked.

2. A mug as set forth in claim 1, wherein said handle is tapered from top to bottom.

3. A mug as set forth in claim 2, wherein said mug body is tapered from top to bottom.

4. A mug as set forth in claim 3, wherein:

said mug body includes a base section adjacent to said bottom; and said wall includes a pair of stacking lugs on said base section on which the bottom of an overlying mug body is received when the mugs are stacked together in a nesting relationship.

5. A mug as set forth in claim 1, wherein said mug body is tapered from top to bottom.

6. A mug as set forth in claim 5, wherein:

said mug body includes a base section adjacent to said bottom; and said wall includes a pair of stacking lugs on said base section on which the bottom of an overlying mug body is received when the mugs are stacked together in a nesting relationship.

7. A mug as set forth in claim 1, wherein said handle has a frusto-conical shape and tapers from top to bottom.

8. A mug as set forth in claim 1, wherein said connecting element includes:

a web portion extending from said wall of the mug body to said handle, said web portion having opposite side edges; and a pair of flanges connected with the respective side edges of said web and extending from said wall to said handle to strengthen and rigidify the connecting element.

9. A mug as set forth in claim 8, including a lip projecting downwardly from each of said flanges at a location adjacent said wall, said lips being situated to rest on the top of an underlying mug body when the mugs are stacked.

10. A mug as set forth in claim 9, including a pair of stacking lugs spaced apart arcuately from one another and from said lips on the mug body, said lugs being located to receive the bottom of an overlying mug body when the mugs are stacked.

11. A mug as set forth in claim 8, including a rim on the top of said handle, said web portion of the connecting element merging with said rim.

12. A mug as set forth in claim 11, including a bevel on said rim.

13. A mug as set forth in claim 8, including a rim on the top of said handle, said rim presenting a beveled portion.

14. A stacking mug construction comprising:

a mug body having an open top and presenting a container for receiving and holding liquids, said mug body tapering from top to bottom and being closed at the bottom;

a substantially flat web projecting outwardly from said mug body near the top thereof and presenting opposite side edges;

a handle having a top end connected with said web and a free bottom end spaced outwardly from the mug body, said handle being open at the top end thereof and tapering downwardly from said top end to said bottom end to thereby fit in the handle of an underlying mug when the mug bodies of two mugs ar nested together; and a pair of flanges connected with the respective side edges of said web and extending between the mug body and handle.

15. The mug construction of claim 14, wherein said web is tapered as it extends away from the mug body and toward said handle.

16. The mug construction of claim 14, wherein said mug body and handle are frusto-conical.

17. A stacking mug construction comprising:

a mug body having a wall and a bottom, said mug body being open at a top thereof and defining a container for receiving and holding liquid in the mug body;

a handle connection element extending outwardly from said wall of the mug body in proximity to the top thereof, said connection element presenting a lip situated to rest on the top of an underlying mug body when two mugs are stacked in a nesting relationship;

a handle connected with said connection element and extending downwardly therefrom at a location spaced away from the mug body, said handle presenting a hollow interior open at the top and terminating in a free lower end spaced away from said wall of the mug body to permit the handle to fit in the handle of an underlying mug when two mugs are stacked in a nesting relationship; and a pair of stacking lugs presenting surfaces within said mug body arcuately spaced thereon from one another and from said lip, said bottom resting on said lug surfaces of an underlying mug when two mugs are stacked in a nesting relationship.

* * * * *